US009855748B2

(12) United States Patent
Horiguchi

(10) Patent No.: US 9,855,748 B2
(45) Date of Patent: Jan. 2, 2018

(54) LIQUID JET HEAD AND LIQUID JET APPARATUS

(71) Applicant: SII PRINTEK INC., Chiba (JP)

(72) Inventor: Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 101 days.

(21) Appl. No.: 14/030,117

(22) Filed: Sep. 18, 2013

(65) Prior Publication Data

US 2014/0085379 A1 Mar. 27, 2014

(30) Foreign Application Priority Data

Sep. 24, 2012 (JP) ..... 2012-209886

(51) Int. Cl.
*B41J 2/14* (2006.01)

(52) U.S. Cl.
CPC ..... *B41J 2/1433* (2013.01); *B41J 2/14209* (2013.01); *B41J 2202/12* (2013.01)

(58) Field of Classification Search
CPC .... B41J 2202/20; B41J 2/155; B41J 2/04525; B41J 2/1433; B41J 2/14209; B41J 2202/12
USPC ..... 347/40, 44
See application file for complete search history.

(56) References Cited

U.S. PATENT DOCUMENTS 5,252,994 A * 10/1993 Narita et al. ..... 347/71
5,499,042 A * 3/1996 Yanagawa ..... B41J 2/14209 347/12
6,106,106 A * 8/2000 Nakazawa et al. ..... 347/68
6,331,050 B1 * 12/2001 Nakata et al. ..... 347/65
6,557,985 B2 * 5/2003 Hosono ..... B41J 2/14274 347/68
7,413,294 B2 * 8/2008 Tobita ..... B41J 2/14233 347/12
7,645,030 B2 * 1/2010 Koseki ..... 347/69
7,891,780 B2 * 2/2011 Ueda ..... B41J 2/1603 347/65
8,317,299 B2 * 11/2012 Brown ..... B41J 2/14233 347/47
8,714,705 B2 * 5/2014 Hasegawa ..... B41J 2/19 347/40
8,845,070 B2 * 9/2014 Yamamoto ..... B41J 2/14209 347/20
2001/0043242 A1 * 11/2001 Takahashi ..... 347/10
2002/0071009 A1 * 6/2002 Yamada ..... B41J 2/14209 347/71

(Continued)

FOREIGN PATENT DOCUMENTS

JP 2011 104791 6/2011

*Primary Examiner* — Patrick King
(74) *Attorney, Agent, or Firm* — Adams & Wilks

(57) ABSTRACT

A liquid jet head includes a nozzle plate having a first nozzle row and a second nozzle row each formed of a plurality of nozzles; and a piezoelectric plate having a plurality of first ejection grooves communicating with respective ones of the plurality of nozzles of the first nozzle row, and a plurality of second ejection grooves communicating with respective ones of the plurality of nozzles of the second nozzle row. The plurality of first ejection grooves and the plurality of second ejection grooves are longitudinally separated from each other in the longitudinal direction of the grooves by a partition wall located between the plurality of first ejection grooves and the plurality of second ejection grooves.

22 Claims, 8 Drawing Sheets

(56) References Cited

U.S. PATENT DOCUMENTS

| | | | | |
|---|---|---|---|---|
| 2010/0013887 | A1* | 1/2010 | Suh | 347/18 |
| 2010/0177133 | A1* | 7/2010 | Makishima | 347/10 |
| 2013/0050338 | A1* | 2/2013 | Shimosato | 347/40 |
| 2013/0187989 | A1* | 7/2013 | Koseki | B41J 2/14209 347/71 |

* cited by examiner

LIQUID JET HEAD AND LIQUID JET APPARATUS

BACKGROUND OF THE INVENTION

1. Field of the Invention

The present invention relates to a liquid jet head for ejecting liquid from a nozzle to record graphics and characters on a recording medium, or to form a functional thin film thereon. The present invention also relates to a liquid jet apparatus using the liquid jet head.

2. Description of the Related Art

In recent years, there has been used an ink-jet type liquid jet head for ejecting ink droplets on recording paper or the like to record characters or graphics thereon, or for ejecting a liquid material on a surface of an element substrate to form a functional thin film thereon. In such a liquid jet head, ink or a liquid material is supplied from a liquid tank via a supply tube to the liquid jet head, and ink or a liquid material filled into a channel is ejected from a nozzle which communicates to the channel. When ink is ejected, the liquid jet head or a recording medium on which a pattern of jetted liquid is to be recorded is moved to record characters or graphics, or to form a functional thin film in a predetermined shape.

FIGS. 9, 10A, and 10B are schematic sectional views of an ink jet head 100 of this type described in Japanese Patent Application Laid-open No. 2011-104791. The ink jet head 100 has a laminate structure including a cover 102 provided with ejection holes 103*a* and 103*b*, a PZT plate 104 formed of a piezoelectric body, a cover plate 108, and a flow path member 111. The PZT plate 104 has one surface provided with elongated deep grooves 105*a*, and shallow grooves 105*b* arrayed adjacent thereto and orthogonal to the elongated direction. The cross section of the deep groove 105*a* in each of the longitudinal direction and the depth direction has a protruded shape in the depth direction. On an upper part of a side wall of each of the grooves 105*a* and 105*b*, an electrode 116 is formed. The cover plate 108 includes a liquid supply duct 109 corresponding to a longitudinal center opening portion of the deep groove 105*a*, and two liquid discharge ducts 110*a* and 110*b* corresponding to opening portions at both longitudinal ends of the deep groove 105*a*.

The ink jet head 100 operates as follows. Liquid supplied from the liquid supply duct 109 flows into the deep grooves 105*a* and 105*c*. Further, the liquid flowing out from the deep grooves 105*a* and 105*c* is discharged from the liquid discharge ducts 110*a* and 110*b*, and thus the liquid is circulated without stagnation. The drive electrode 116 formed on the wall surface of the side wall for sectioning the deep groove 105*c* and the shallow groove 105*b* is electrically separated at a longitudinal center portion of each of the deep groove 105*c* and the shallow groove 105*b*. When the liquid is jetted from the ejection hole 103*a*, a drive voltage is applied to the drive electrode on the ejection hole 103*a* side to deform the side wall on the ejection hole 103*a* side. When the liquid is jetted from the ejection hole 103*b*, a drive voltage is applied to the drive electrode on the ejection hole 103*b* side to deform the side wall on the ejection hole 103*b* side. Further, the shallow grooves 105*b* are formed across the deep groove 105*a*, and are closed by the cover plate 108 so as to prevent the liquid from entering the shallow grooves 105*b*. Therefore, conductive liquid can be used, and the side wall of each deep groove 105*a* can be controlled independently from the drive of the adjacent deep groove. That is, liquid can be independently jetted from two nozzles, and the deep groove is not affected by the drive voltage for driving the adjacent deep groove. Therefore, the recording density and the recording speed can be improved.

However, in the above-mentioned conventional example of FIGS. 9, 10A, and 10B, in order to increase the resolution, the deep groove 105*a* is provided with two ejection holes 103*a* and 103*b*. Therefore, when liquid is ejected from one ejection hole 103*a*, the liquid may also be ejected from the other ejection hole 103*b*.

Further, due to a pressure wave generated when a voltage is applied to the side wall to drive the drive electrode for ejection from one ejection hole, the liquid may be ejected from the other ejection hole. In addition, the pressure wave may affect a pressure wave generated when the drive electrode is driven for ejection from the other ejection hole to cause wave overlapping. Thus, stable ejection cannot be performed, and hence an advanced drive voltage control has been required.

SUMMARY OF THE INVENTION

The present invention has been made in view of the above-mentioned circumstances, and provides a liquid jet head having a structure capable of reducing the stagnation or accumulation of liquid and performing stable ejection without the need of an advanced drive voltage control even in high resolution, and a liquid jet apparatus.

According to an exemplary embodiment of the present invention, there is provided a liquid jet head, including: a nozzle plate including a first nozzle row and a second nozzle row each formed of a plurality of nozzles; and a piezoelectric plate including a plurality of first ejection grooves communicating to the plurality of nozzles of the first nozzle row, and a plurality of second ejection grooves communicating to the plurality of nozzles of the second nozzle row, in which each of the plurality of first ejection grooves and each of the plurality of second ejection grooves are separated from each other by a partition wall located between the each of the plurality of first ejection grooves and the each of the plurality of second ejection grooves.

Further, in the liquid jet head, an arrangement direction of the first nozzle row and the second nozzle row is orthogonal to a longitudinal direction of the plurality of first ejection grooves and the plurality of second ejection grooves.

Further, in the liquid jet head, a longitudinal direction of the plurality of first ejection grooves and the plurality of second ejection grooves is inclined at a predetermined angle relative to an arrangement direction of the first nozzle row and the second nozzle row.

Further, in the liquid jet head, the piezoelectric plate further includes a plurality of first non-ejection grooves formed alternately with the plurality of first ejection grooves in an arrangement direction of the first nozzle row, and a plurality of second non-ejection grooves formed alternately with the plurality of second ejection grooves in an arrangement direction of the second nozzle row.

Further, in the liquid jet head, the each of the plurality of first ejection grooves and each of the plurality of second non-ejection grooves are adjacent to each other through intermediation of the partition wall, and the each of the plurality of second ejection grooves and each of the plurality of first non-ejection grooves are adjacent to each other through intermediation of the partition wall.

Further, in the liquid jet head, the each of the plurality of first ejection grooves and the each of the plurality of second ejection grooves are adjacent to each other through intermediation of the partition wall, and each of the plurality of first non-ejection grooves and each of the plurality of second non-ejection grooves are adjacent to each other through intermediation of the partition wall.

Further, in the liquid jet head, the plurality of nozzles are provided in a staggered arrangement in which, in an arrangement direction of the plurality of nozzles, each of nozzles in the first nozzle row is located between nozzles in the second nozzle row.

Further, the liquid jet head further includes a cover plate including: a first supply ink chamber communicating to the plurality of first ejection grooves, for supplying liquid to the plurality of first ejection grooves; a first discharge ink chamber for discharging the liquid from the plurality of first ejection grooves; a second supply ink chamber communicating to the plurality of second ejection grooves, for supplying the liquid to the plurality of second ejection grooves; and a second discharge ink chamber for discharging the liquid from the plurality of second ejection grooves.

Further, the liquid jet head further includes a flow path member including: a supply port for supplying the liquid to the first supply ink chamber and the second supply ink chamber; and a discharge port for discharging the liquid from the first discharge ink chamber and the second discharge ink chamber.

Further, the liquid jet head further includes a reinforcing plate bonded between the nozzle plate and the piezoelectric plate, the reinforcing plate including a plurality of through holes respectively communicating to the plurality of nozzles, the plurality of first ejection grooves, and the plurality of second ejection grooves.

Further, there is provided a liquid jet apparatus including any one of the above-mentioned liquid jet heads.

According to the exemplary embodiment of the present invention, the liquid flows into the ejection groove from one surface side, and flows out from the same one surface side, but the liquid is not supplied to the non-ejection groove adjacent to this ejection groove. Therefore, in the region inside the ejection groove, the liquid is less liable to accumulate, and foreign matters inside the liquid, including air bubbles and dust, can be promptly removed from the region inside the groove. Further, the liquid is not supplied to the region inside the non-ejection groove, and the high voltage side and the low voltage side of the electrode to be formed may be electrically separated from each other. Therefore, conductive liquid may be used, and nozzle clogging may be reduced.

Still further, the non-ejection grooves and the ejection grooves are arrayed adjacent to each other alternately in the longitudinal direction, and are arrayed in two rows in the direction perpendicular to the longitudinal direction while being shifted by a half pitch. Therefore, the exemplary embodiment of the present invention may provide the liquid jet head capable of ejecting liquid without ejecting liquid from other ejection nozzles and performing stable ejection without the need of an advanced drive voltage control while achieving high resolution.

DETAILED DESCRIPTION OF THE PREFERRED EMBODIMENTS

First Embodiment

Figure 1A:
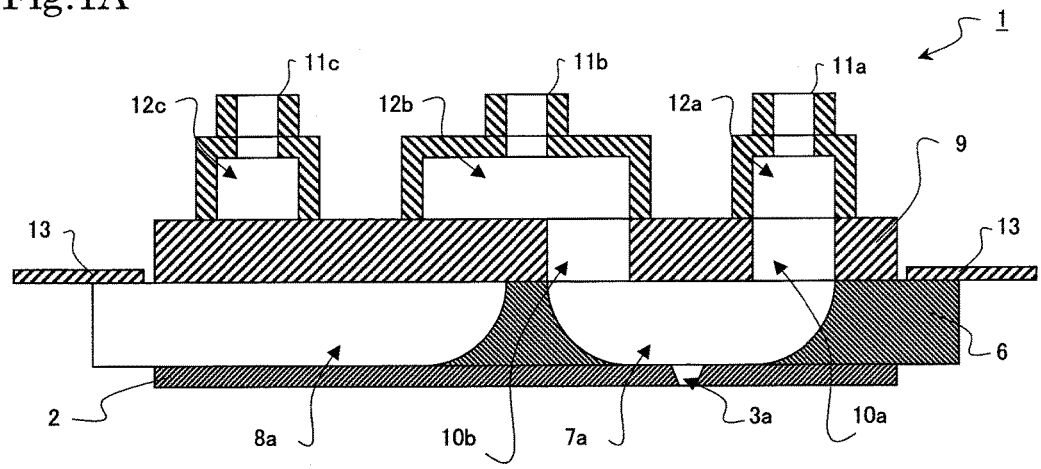
FIGS. 1A and 1B are schematic vertical sectional views of a liquid jet head according to a first embodiment of the present invention.
Figure 1B:
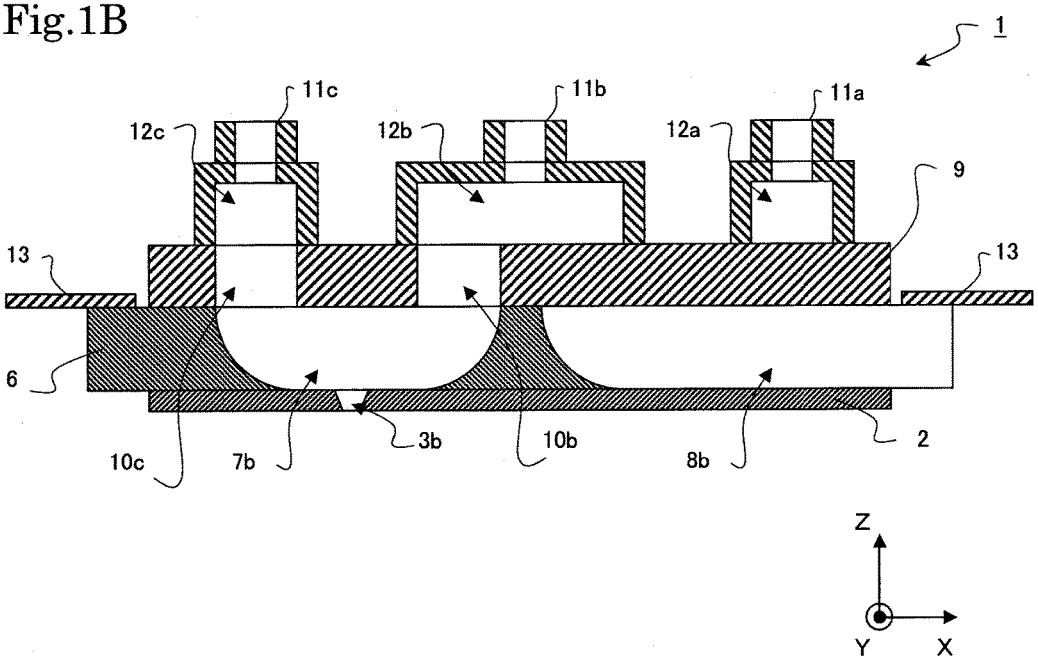
Figure 2:
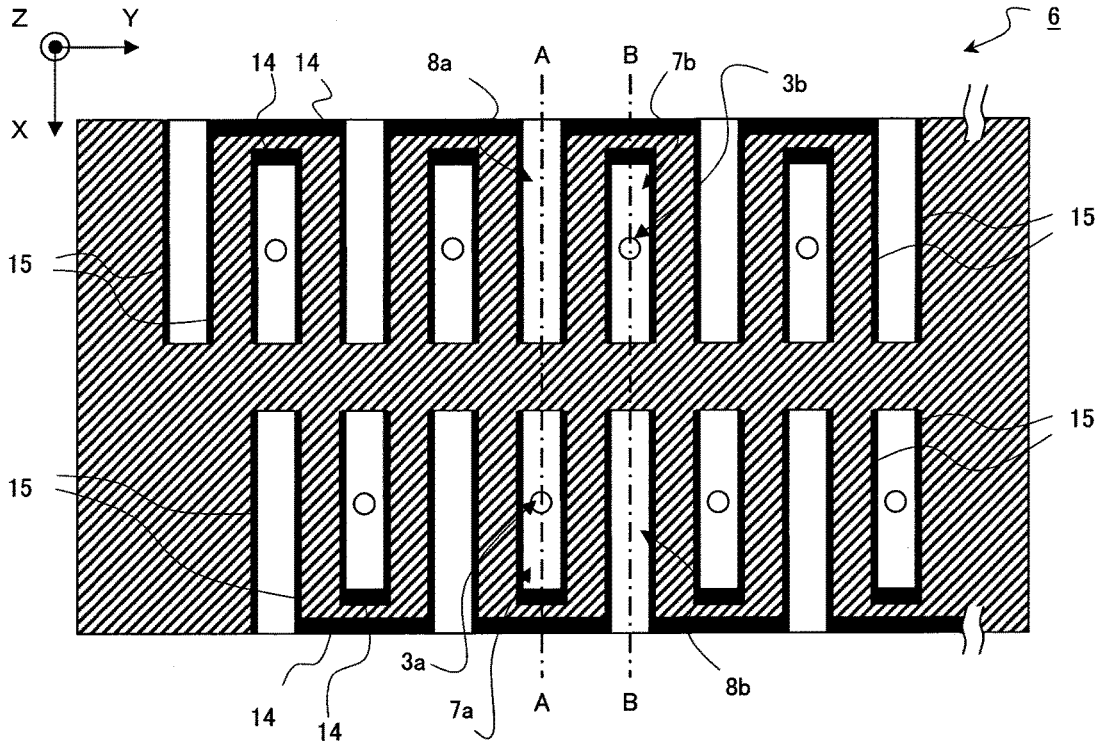
FIG. 2 is a top view of a piezoelectric plate according to the first embodiment of the present invention.

FIGS. 1A and 1B are schematic vertical sectional views of a liquid jet head 1 according to a first embodiment of the present invention, and FIG. 2 is a top view after grooves are formed in a piezoelectric plate. FIG. 2 is illustrated in a manner that the right side of the drawing is omitted. Note that, FIG. 1A is a schematic vertical sectional view of the liquid jet head 1 in a cross section taken along the line A-A of FIG. 2, and FIG. 1B is a schematic vertical sectional view of the liquid jet head 1 in a cross section taken along the line B-B of FIG. 2.

Referring to FIGS. 1A, 1B, and 2, the liquid jet head 1 is described. The liquid jet head 1 has a structure in which a nozzle plate 2, a piezoelectric plate 6, a cover plate 9, and flow path members 11 (11*a*, 11*b*, and 11*c*) are laminated from the lower side of FIGS. 1A and 1B. As the piezoelectric plate 6, for example, a piezoelectric ceramics made of lead zirconate titanate (PZT) or the like may be used. The piezoelectric plate 6 has one surface provided with a plurality of longitudinally extending ejection grooves 7 (7*a* and 7*b*) and a plurality of longitudinally extending non-ejection grooves 8 (8*a* and 8*b*). The ejection groove 7 and the non-ejection groove 8 each have a longitudinal direction in an X direction and a groove depth direction in a Z direction, and are alternately arrayed in a Y direction that is a direction orthogonal to the X direction and the Z direction.

The ejection groove 7 has inclined portions at both ends in the X direction, which gradually increase their depth from a surface of the piezoelectric plate 6 to which the cover plate 9 is bonded toward the Z direction. The ejection groove 7 is communicated to a nozzle 3 to be described later at a position where the depth in the Z direction is largest. The inclined shape of the inclined portion described herein is formed as, for example, a trace of a blade of a circular dicing saw when the dicing saw is used to form the ejection groove 7.

The non-ejection groove 8 has an inclined portion which gradually increases its depth from the surface of the piezoelectric plate 6 to which the cover plate 9 is bonded toward the Z direction, but unlike the ejection groove 7, the non-ejection groove 8 has the inclined portion only at one end. Note that, as illustrated in FIGS. 1A and 1B, the non-ejection groove 8 is formed up to the end portion of the piezoelectric plate 6 in the X direction in a manner that the other end keeps the largest depth in the Z direction.

Further, the piezoelectric plate 6 has a groove arrangement of two rows on the upper and lower sides of FIG. 2. In each of the arrangements on the upper and lower sides of FIG. 2, the ejection grooves 7 and the non-ejection grooves 8 are alternately arrayed in the Y direction. Further, the ejection groove 7 on the upper side of FIG. 2 is opposed to the non-ejection groove 8 on the lower side of FIG. 2 in the X direction, and the non-ejection groove 8 on the upper side of FIG. 2 is opposed to the ejection groove 7 on the lower side of FIG. 2 in the X direction. That is, the ejection grooves 7 and the non-ejection grooves 8 on the upper side of FIG. 2 and the ejection grooves 7 and the non-ejection grooves 8 on the lower side of FIG. 2 are arrayed in a similar form while being shifted by a half pitch in the Y direction as illustrated in FIG. 2. In other words, nozzles 3*a* communicating to the ejection grooves 7*a* and nozzles 3*b* communicating to the ejection grooves 7*b* are arranged in a staggered arrangement in an XY plane. The width of each groove in the Y direction may be, for example, 50 μm to 100 μm, and the width of the side wall separating the respective grooves 7 and 8 may also be 50 μm to 100 μm. Note that, the ejection groove 7*a* and the ejection groove 7*b* have the same channel length in the X direction.

The cover plate 9 is bonded onto one surface of the piezoelectric plate 6. The cover plate 9 is configured to close the non-ejection grooves, to thereby prevent entrance of liquid. Note that, the cover plate 9 is bonded to the piezoelectric plate 6 so that the surface of the piezoelectric plate 6 (surface to which the cover plate 9 is bonded) is exposed by a predetermined area at both ends in the X direction. A flexible substrate 13 is fitted by application of pressure to the exposed surface of the piezoelectric plate 6 so as to cover the surface.

On the flexible substrate 13, a wiring electrode (not shown) is patterned. The wiring electrode is bonded to a surface electrode 14 included in the exposed surface of the piezoelectric plate 6 illustrated in FIG. 2. The surface electrode 14 is formed so as to correspond to each of the ejection groove 7 and the non-ejection groove 8. Note that, regarding the surface electrode 14 of the non-ejection groove 8, the non-ejection grooves 8 adjacent to the corresponding ejection groove 7 share the surface electrode 14 at an end surface of the piezoelectric plate 6. Those surface electrodes 14 are electrically connected to drive electrodes 15 formed on respective side walls of the ejection grooves 7 and the non-ejection grooves 8 provided in the piezoelectric plate 6. The drive electrode 15 is formed on substantially the upper half of the ejection groove 7 in the Z direction from the +Z direction of the side wall (the surface side of the piezoelectric plate 6 to which the flexible substrate 13 is bonded). The drive electrode 15 can be formed by a known oblique deposition method.

Note that, in this embodiment of the present invention, a drive system called a chevron system can be employed. In the chevron system, the piezoelectric plate is formed of two piezoelectric substrates, and the drive electrode 15 is formed on the entire side wall from the +Z direction to the −Z direction. In this case, the drive electrode 15 may be formed on the entire side wall by a known plating method.

In such a liquid jet head 1, descriptions are made of, by referring to FIGS. 1A and 1B, the route for supplying the liquid to the nozzles 3 (3*a* and 3*b*), and the route for causing the liquid to pass the vicinity of the nozzles 3 for discharge.

First, liquid (ink) is sent from the Z side of FIGS. 1A and 1B of the flow path member 11*a* and the flow path member 11*c* to a first liquid chamber 12*a* and a third liquid chamber 12*c*, respectively. In order to send the liquid to the first liquid chamber 12*a* and the third liquid chamber 12*c* from a liquid tank (not shown), a tube having a predetermined diameter and a pump device having a predetermined liquid sending force may be used. Then, the liquid that has passed through the first liquid chamber 12*a* and the third liquid chamber 12*c* reaches the ejection grooves 7 via a first common ink chamber 10*a* and a third common ink chamber 10*c* of the supply side, passes through a second common ink chamber 10*b*, and is sent to a second liquid chamber 12*b* to be discharged from the flow path member 11*b*. In other words, the discharge paths of the ejection grooves 7 arranged in the upper and lower rows join together inside the flow path member 11*b*. With this, a common discharge path is provided to the plurality of ejection grooves that are communicated to different nozzle rows, and thus the head chip can be more downsized. Note that, the flow path member 11*a* and the flow path member 11*c* are set as supply ports and the flow path member 11*b* is set as a discharge port, but the flow path member 11*b* may be set as the supply port and the flow path member 11*a* and the flow path member 11*c* may be set as the discharge ports.

In addition, a liquid jet head 1 which we stated above is placed to a liquid jet apparatus.

Second Embodiment

Figure 3:
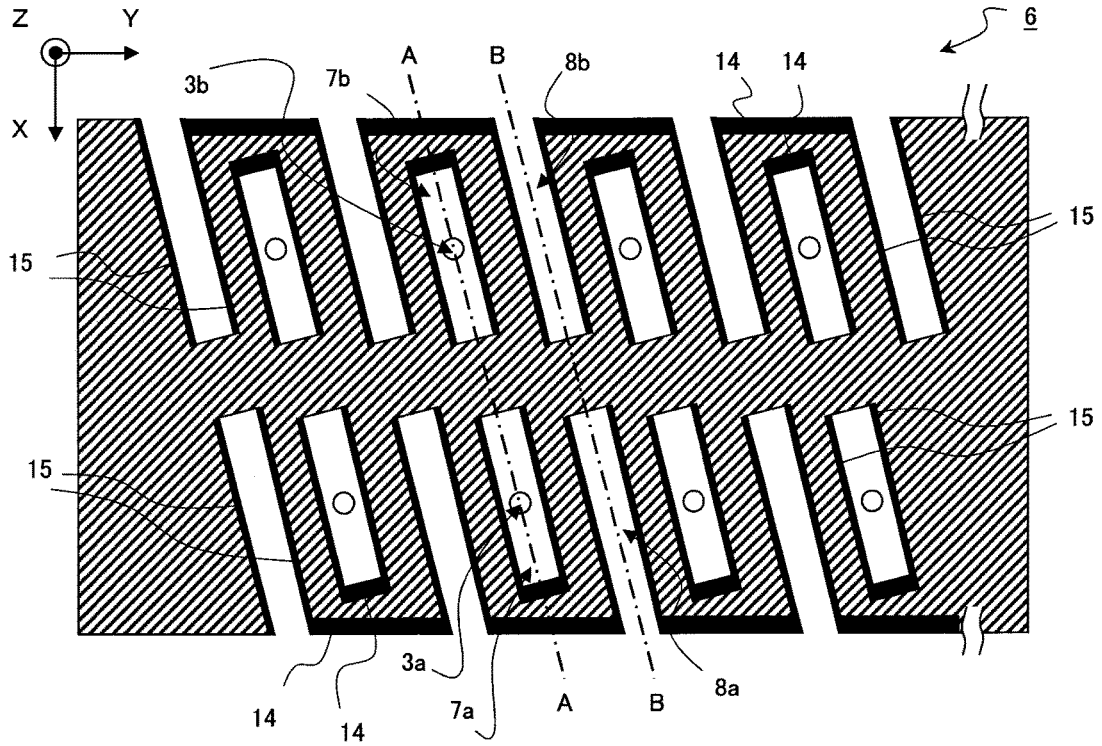
FIG. 3 is a top view of a piezoelectric plate according to a second embodiment of the present invention.
Figure 4A:
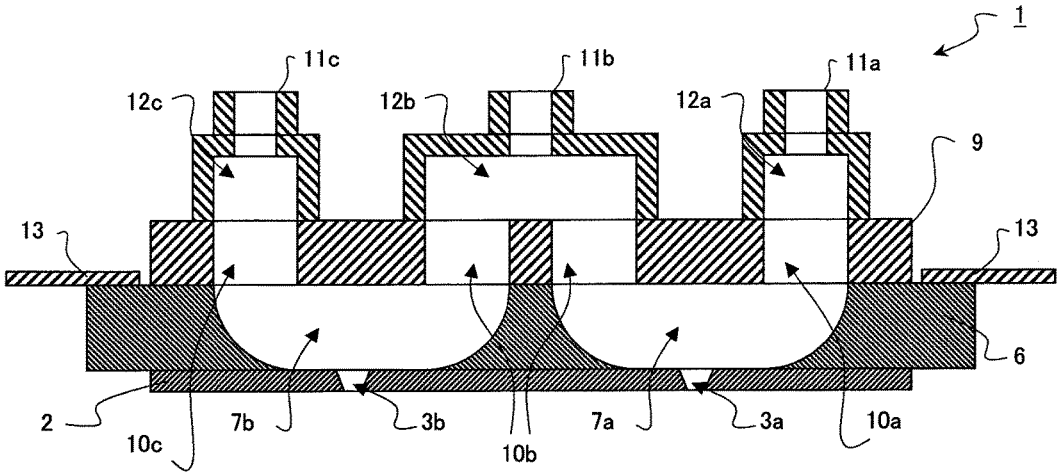
FIGS. 4A and 4B are schematic vertical sectional views of a liquid jet head according to the second embodiment of the present invention.
Figure 4B:
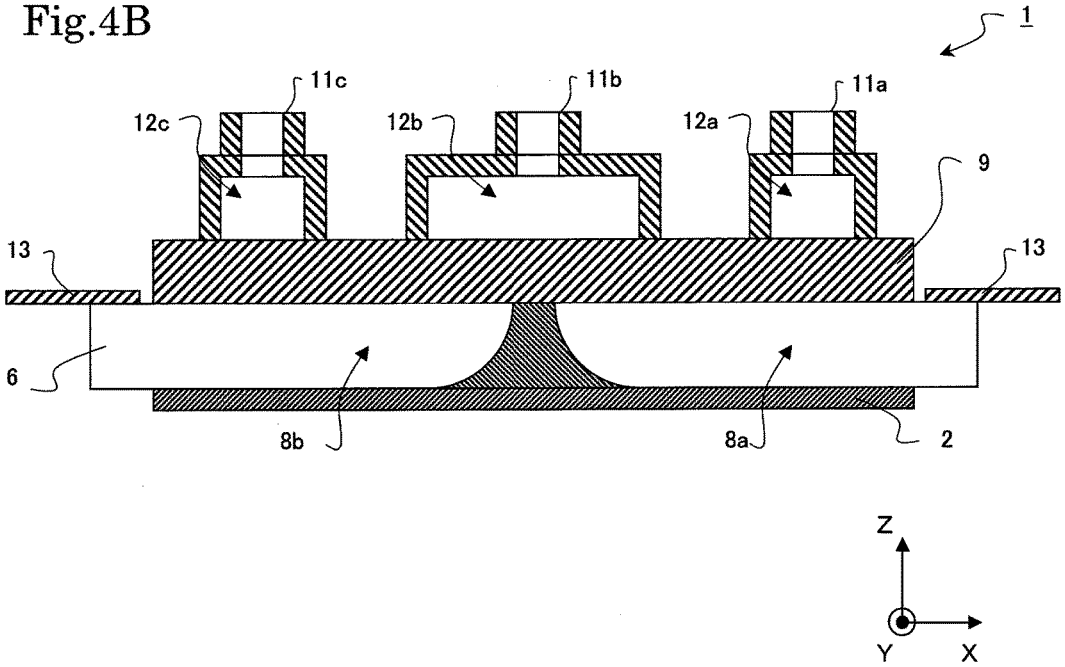

FIG. 3 is a top view after the grooves are formed in the piezoelectric plate of the liquid jet head 1 according a second embodiment of the present invention, and FIGS. 4A and 4B are schematic vertical sectional views of the liquid jet head 1 according the second embodiment of the present invention. FIG. 3 is illustrated in a manner that the right side of the drawing is omitted. Note that, FIG. 4A is a schematic vertical sectional view of the liquid jet head 1 in a cross section taken along the line A-A of FIG. 3, and FIG. 4B is a schematic vertical sectional view of the liquid jet head 1 in a cross section taken along the line B-B of FIG. 3.

The second embodiment differs from the first embodiment in the shape of the ejection groove 7 and the non-ejection groove 8, and other configurations are the same as those in the first embodiment. Therefore, in the following, configurations different from those in the first embodiment are mainly described. The same parts or parts having the same functions are denoted by the same reference symbols.

First, referring to FIG. 3, the piezoelectric plate 6 of the liquid jet head 1 is described.

The grooves are arrayed in two rows on the upper and lower sides of FIG. 3, and in each of the arrangements on the upper and lower sides of FIG. 3, the ejection grooves 7 and the non-ejection grooves 8 are also alternately arrayed in the Y direction. The second embodiment differs from the first embodiment in that the ejection grooves 7 and the non-ejection grooves 8 are inclined at a predetermined angle relative to the X axis. The predetermined angle is, for example, 15° in this embodiment, but may be any angle. Further, in the A-A cross section, the ejection groove 7 on the upper side of FIG. 3 and the ejection groove 7 on the lower side of FIG. 3 are opposed to each other, and in the B-B cross section, the non-ejection groove 8 on the upper side of FIG. 3 and the non-ejection groove 8 on the lower side of FIG. 3 are opposed to each other. That is, the ejection grooves 7 and the non-ejection grooves 8 on the upper side of FIG. 3 and the ejection grooves 7 and the non-ejection grooves 8 on the lower side of FIG. 3 are arrayed in a similar form while being shifted by a half pitch in the Y direction as illustrated in FIG. 3. In other words, the nozzles 3*a* communicating to the ejection grooves 7*a* and the nozzles 3*b* communicating to the ejection grooves 7*b* are arranged in a staggered arrangement in the XY plane. The width of each groove may be, for example, 50 μm to 100 μm, and the width of the side wall separating the respective grooves 7 and 8 may also be 50 μm to 100 μm.

Next, referring to FIGS. 4A and 4B, the liquid jet head 1 is described.

The liquid jet head 1 has a structure in which the nozzle plate 2, the piezoelectric plate 6, the cover plate 9, and the flow path members 11 (11*a*, 11*b*, and 11*c*) are laminated from the lower side of FIGS. 4A and 4B. The piezoelectric plate 6 has one surface provided with the plurality of ejection grooves 7 (7*a* and 7*b*) and the plurality of non-ejection grooves 8 (8*a* and 8*b*). The ejection groove 7 and the non-ejection groove 8 each have a longitudinal direction in the X direction and a groove depth direction in the Z direction, and are alternately arrayed in the Y direction that is a direction orthogonal to the X direction and the Z direction. Referring to FIG. 4A, the nozzles 3 are formed in the nozzle plate 2 in the A-A cross section, and the ejection grooves 7 communicating to the nozzles 3 are opposed to each other in the A-A cross section so that the flow paths corresponding to the ejection grooves 7 join together in the second liquid chamber 12*b*. Referring to FIG. 4B, the non-ejection grooves 8 are opposed to each other in the B-B cross section. The non-ejection grooves 8 do not communicate to the first to third liquid chambers 12*a* to 12*c*.

In such a liquid jet head 1, descriptions are made of, by referring to FIG. 4A, the route for supplying the liquid to the nozzles 3 (3*a* and 3*b*), and the route for causing the liquid to pass the vicinity of the nozzles 3 for discharge.

First, the liquid (ink) is sent from the Z side of FIG. 4A of the flow path member 11*a* and the flow path member 11*c* to the first liquid chamber 12*a* and the third liquid chamber 12*c*, respectively. In order to send the liquid to the first liquid chamber 12*a* and the third liquid chamber 12*c* from the liquid tank (not shown), the tube having the predetermined diameter and the pump device having the predetermined liquid sending force may be used. Then, the liquid that has passed through the first liquid chamber 12*a* and the third liquid chamber 12*c* reaches the ejection grooves 7 via the first common ink chamber 10*a* and the third common ink chamber 10*c* of the supply side, passes through the second common ink chamber 10*b*, and is sent to the second liquid chamber 12*b* to be discharged from the flow path member 11*b*. In other words, the discharge paths of the ejection grooves 7 arranged in the upper and lower rows join together inside the flow path member 11*b*. With this, a common discharge path is provided to the plurality of ejection grooves that are communicated to different nozzle rows, and thus the head chip can be more downsized. Note that, the flow path member 11*a* and the flow path member 11*c* are set as the supply ports and the flow path member 11*b* is set as the discharge port, but the flow path member 11*b* may be set as the supply port and the flow path member 11*a* and the flow path member 11*c* may be set as the discharge ports.

With such a configuration, the nozzle pitch can be reduced as compared to the case of the first embodiment. The nozzle pitch of the liquid jet head 1 of the first embodiment is dominated by the thickness of the side wall and the groove width. However, regarding the nozzle pitch of the liquid jet head 1 of the second embodiment, by adjusting the angle of the channel and the longitudinal length of the ejection groove 7 in the XY plane, the nozzle pitch in the staggered arrangement can be reduced.

Third Embodiment

Figure 5:
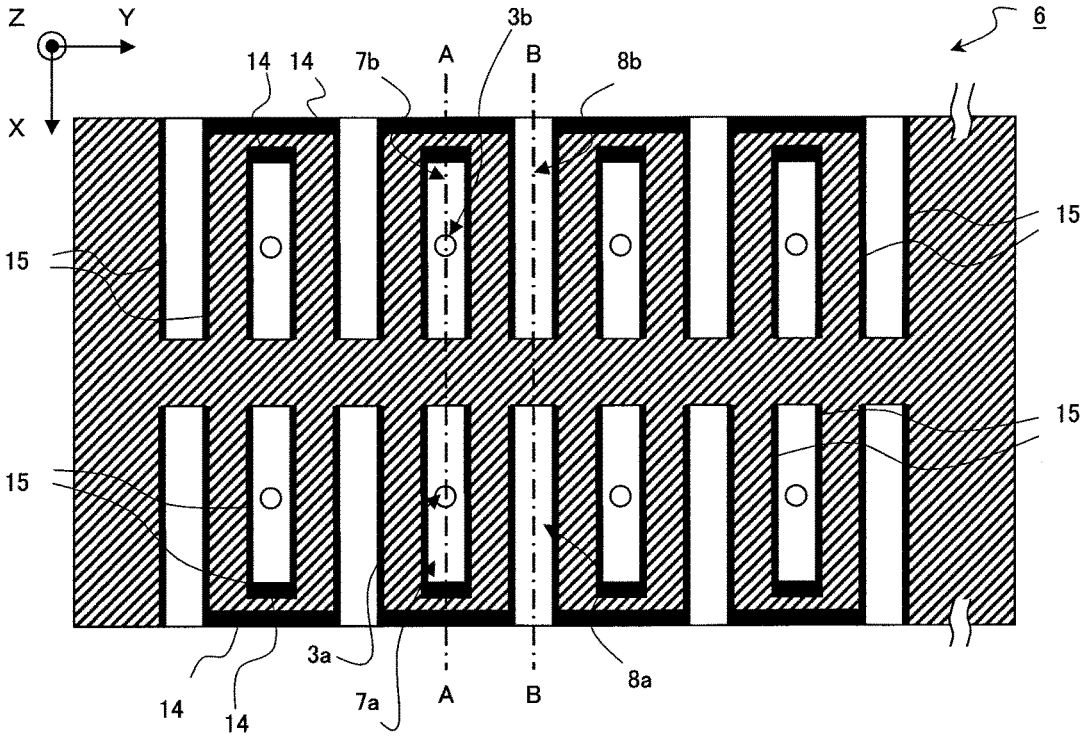
FIG. 5 is a top view of a piezoelectric plate according to a third embodiment of the present invention.

FIG. 5 is a top view after the grooves are formed in the piezoelectric plate of the liquid jet head 1 according a third embodiment of the present invention. FIG. 5 is illustrated in a manner that the right side of the drawing is omitted.

The third embodiment differs from the first or second embodiment in the shape of the ejection groove 7 and the non-ejection groove 8, and other configurations are the same as those in the first or second embodiment. Therefore, in the following, configurations different from those in the first or second embodiment are mainly described. The same parts or parts having the same functions are denoted by the same reference symbols.

Referring to FIG. 5, the piezoelectric plate 6 of the liquid jet head 1 is described.

The piezoelectric plate 6 has the grooves arrayed in two rows on the upper and lower sides of FIG. 5, and in each of the arrangements on the upper and lower sides of FIG. 5, the ejection grooves 7 and the non-ejection grooves 8 are also alternately arrayed in the Y direction. Further, the ejection grooves 7 on the upper and lower sides of FIG. 5 are opposed to each other in the X direction and the non-ejection grooves 8 on the upper and lower sides of FIG. 5 are opposed to each other in the X direction. That is, unlike the first and second embodiment, the ejection grooves 7 and the non-ejection grooves 8 on the upper side of FIG. 5 and the ejection grooves 7 and the non-ejection grooves 8 on the lower side of FIG. 5 are arrayed in a similar form in the Y direction as illustrated in FIG. 5. In other words, the nozzles 3*a* communicating to the ejection grooves 7*a* and the nozzles 3*b* communicating to the ejection grooves 7*b* are not in a staggered arrangement in the XY plane, but are arranged so that the positions of the nozzles in the upper row and the positions of the nozzles in the lower row overlap with each other in the X direction, and the positions of the nozzles in the upper row overlap with each other and the positions of the nozzles in the lower row overlap with each other in the Y direction.

In the liquid jet head 1, the A-A cross section and the B-B cross section are orthogonal cross sections, but the sectional views fin those cross sections are the same as the oblique sectional views of FIGS. 4A and 4B illustrating the second embodiment, and hence the sectional views are omitted.

Referring to FIG. 4A, the nozzles 3 are formed in the nozzle plate 2 in the A-A cross section, and the ejection grooves 7 communicating to the nozzles 3 are opposed to each other in the A-A cross section so that the flow paths corresponding to the ejection grooves 7 join together in the second liquid chamber 12*b*. Referring to FIG. 4B, the non-ejection grooves 8 are opposed to each other in the B-B cross section. The non-ejection grooves 8 do not communicate to the first to third liquid chambers 12*a* to 12*c*.

In such a liquid jet head 1, descriptions are made of the route for supplying the liquid to the nozzles 3 (3*a* and 3*b*), and the route for causing the liquid to pass the vicinity of the nozzles 3 for discharge.

First, the liquid (ink) is sent from the Z side of FIG. 4A of the flow path member 11*a* and the flow path member 11*c* to the first liquid chamber 12*a* and the third liquid chamber 12*c*, respectively. In order to send the liquid to the first liquid chamber 12*a* and the third liquid chamber 12*c* from the liquid tank (not shown), the tube having the predetermined diameter and the pump device having the predetermined liquid sending force may be used. Then, the liquid that has passed through the first liquid chamber 12*a* and the third liquid chamber 12*c* reaches the ejection grooves 7 via the first common ink chamber 10*a* and the third common ink chamber 10*c* of the supply side, passes through the second common ink chamber 10*b*, and is sent to the second liquid chamber 12*b* to be discharged from the flow path member

11*b*. Note that, the flow path member 11*a* and the flow path member 11*c* are set as the supply ports and the flow path member 11*b* is set as the discharge port, but the flow path member 11*b* may be set as the supply port and the flow path member 11*a* and the flow path member 11*c* may be set as the discharge ports.

With such a configuration, the discharge paths of the ejection grooves 7 arranged in the upper and lower rows join together inside the flow path member 11*b*. With this, a common discharge path is provided to the plurality of ejection grooves that are communicated to different nozzle rows, and thus the head chip can be more downsized.

Fourth Embodiment

Figure 6:
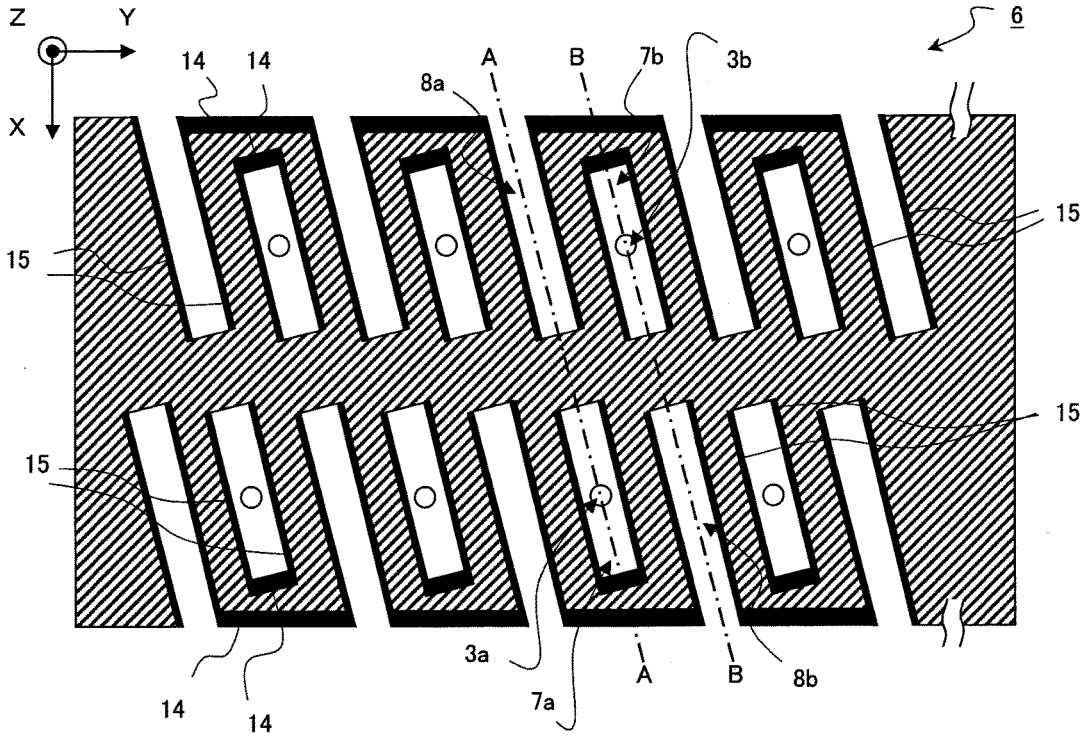
FIG. 6 is a top view of a piezoelectric plate according to a fourth embodiment of the present invention.

FIG. 6 is a top view after the grooves are formed in the piezoelectric plate of the liquid jet head 1 according a fourth embodiment of the present invention. FIG. 6 is illustrated in a manner that the right side of the drawing is omitted.

The fourth embodiment differs from the first or second embodiment in the shape of the ejection groove 7 and the non-ejection groove 8, and other configurations are the same as those in the first or second embodiment. Therefore, in the following, configurations different from those in the first or second embodiment are mainly described. The same parts or parts having the same functions are denoted by the same reference symbols.

Referring to FIG. 6, the piezoelectric plate 6 of the liquid jet head 1 is described.

The piezoelectric plate 6 has the grooves arrayed in two rows on the upper and lower sides of FIG. 6, and in each of the arrangements on the upper and lower sides of FIG. 6, the ejection grooves 7 and the non-ejection grooves 8 are alternately arrayed in the Y direction. Further, the ejection grooves 7 and the non-ejection grooves 8 on the upper side of FIG. 6 and the ejection grooves 7 and the non-ejection grooves 8 on the lower side of FIG. 6 are opposed to each other in the X direction while being inclined at a predetermined angle. That is, the ejection grooves 7 and the non-ejection grooves 8 on the upper side of FIG. 6 and the ejection grooves 7 and the non-ejection grooves 8 on the lower side of FIG. 6 are arrayed while being shifted by a half pitch in the Y direction as illustrated in FIG. 6. However, unlike the first and second embodiments, because the ejection grooves 7 and the non-ejection grooves 8 are inclined at a predetermined angle relative to the X direction, the nozzles 3*a* communicating to the ejection grooves 7*a* and the nozzles 3*b* communicating to the ejection grooves 7*b* are not arranged in a staggered arrangement in the XY plane. The width of each groove may be, for example, 50 μm to 100 μm, and the width of the side wall separating the respective grooves 7 and 8 may also be 50 μm to 100 μm.

In the liquid jet head 1, the A-A cross section and the B-B cross section are oblique cross sections, but the sectional views in those cross sections are the same as the orthogonal sectional views of FIGS. 1A and 1B illustrating the first embodiment, and hence the sectional views are omitted.

In such a liquid jet head 1, descriptions are made of the route for supplying the liquid to the nozzles 3 (3*a* and 3*b*), and the route for causing the liquid to pass the vicinity of the nozzles 3 for discharge.

First, the liquid (ink) is sent from the Z side of FIGS. 1A and 1B of the flow path member 11*a* and the flow path member 11*c* to the first liquid chamber 12*a* and the third liquid chamber 12*c*, respectively. In order to send the liquid to the first liquid chamber 12*a* and the third liquid chamber 12*c* from the liquid tank (not shown), the tube having the predetermined diameter and the pump device having the predetermined liquid sending force may be used. Then, the liquid that has passed through the first liquid chamber 12*a* and the third liquid chamber 12*c* reaches the ejection grooves 7 via the first common ink chamber 10*a* and the third common ink chamber 10*c* of the supply side, passes through the second common ink chamber 10*b*, and is sent to the second liquid chamber 12*b* to be discharged from the flow path member 11*b*. Note that, the flow path member 11*a* and the flow path member 11*c* are set as the supply ports and the flow path member 11*b* is set as the discharge port, but the flow path member 11*b* may be set as the supply port and the flow path member 11*a* and the flow path member 11*c* may be set as the discharge ports.

With such a configuration, the discharge paths of the ejection grooves 7 arranged in the upper and lower rows join together inside the flow path member 11*b*. With this, a common discharge path is provided to the plurality of ejection grooves that are communicated to different nozzle rows, and thus the head chip can be more downsized.

Fifth Embodiment

Figure 7A:
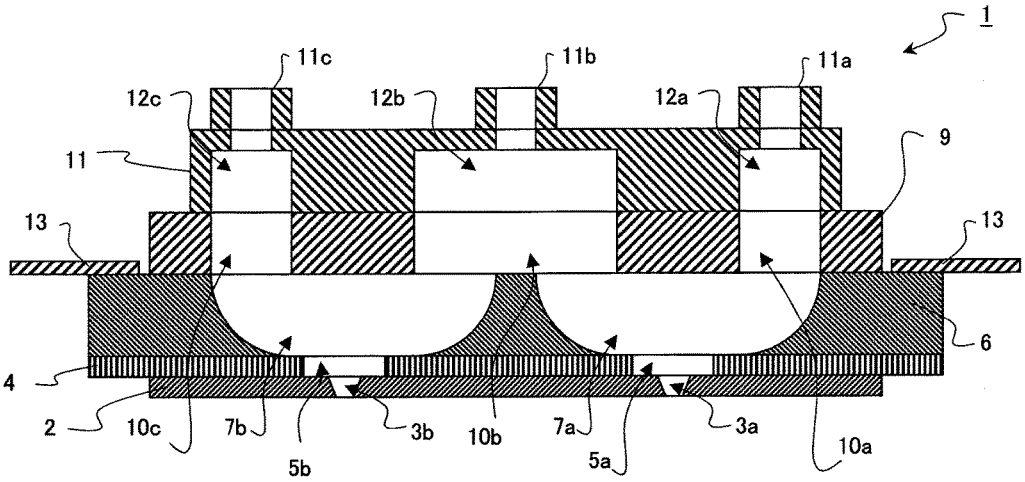
FIGS. 7A and 7B are schematic vertical sectional views of a liquid jet head according to a fifth embodiment of the present invention.
Figure 7B:
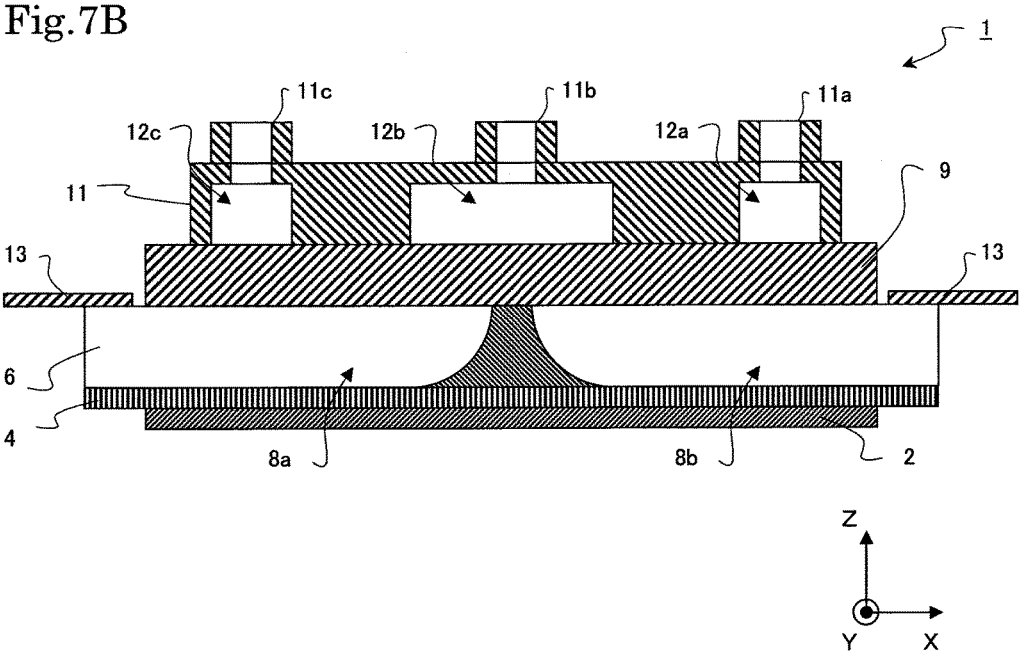

FIGS. 7A and 7B are schematic vertical sectional views of the liquid jet head 1 according to a fifth embodiment of the present invention. Note that, FIG. 7A is a schematic vertical sectional view of the liquid jet head 1 in the A-A cross section corresponding to FIG. 4A, and FIG. 7B is a schematic vertical sectional view of the liquid jet head 1 in the B-B cross section corresponding to FIG. 4B.

The fifth embodiment differs from the second embodiment in the following points. Between the piezoelectric plate 6 and the nozzle plate 2, a reinforcing plate 4 is formed. The flow path member 11 is integrally formed. A common second common ink chamber 10*b* is provided inside the cover plate 9. Other configurations are the same as those in the second embodiment. Therefore, in the following, configurations different from those in the second embodiment are mainly described. The same parts or parts having the same functions are denoted by the same reference symbols.

First, referring to FIGS. 7A and 7B, the piezoelectric plate 6 of the liquid jet head 1 is described.

The liquid jet head 1 has a structure in which the nozzle plate 2, the reinforcing plate 4, the piezoelectric plate 6, the cover plate 9, and the flow path member 11 (11*a*, 11*b*, and 11*c*) are laminated from the lower side of FIGS. 7A and 7B. The piezoelectric plate 6 has one surface provided with the plurality of ejection grooves 7 (7*a* and 7*b*) and the plurality of non-ejection grooves 8 (8*a* and 8*b*). The ejection groove 7 and the non-ejection groove 8 each have a longitudinal direction in the X direction and a groove depth direction in the Z direction, and are alternately arrayed in the Y direction that is a direction orthogonal to the X direction and the Z direction.

As illustrated in FIGS. 7A and 7B, the reinforcing plate 4 is provided with through holes 5 (5*a* and 5*b*) communicating to the ejection grooves 7 and the nozzles 3, respectively.

In such a liquid jet head 1, descriptions are made of, by referring to FIGS. 7A and 7B, the route for supplying the liquid to the nozzles 3 (3*a* and 3*b*), and the route for causing the liquid to pass the vicinity of the nozzles 3 for discharge.

First, the liquid (ink) is sent from the Z side of FIGS. 7A and 7B of the flow path member 11*a* and the flow path member 11*c* of the integrally formed flow path member 11 to the first liquid chamber 12*a* and the third liquid chamber 12*c*, respectively. In order to send the liquid to the first liquid chamber 12*a* and the third liquid chamber 12*c* from the liquid tank (not shown), the tube having the predetermined diameter and the pump device having the predetermined liquid sending force may be used. Then, the liquid that has passed through the first liquid chamber 12*a* and the third liquid chamber 12*c* reaches the ejection grooves 7 via the first common ink chamber 10*a* and the third common ink chamber 10*c* of the supply side, passes through the common second common ink chamber 10*b* provided inside the cover plate 9, and is sent to the second liquid chamber 12*b* to be discharged from the flow path member 11*b*. With this, a common discharge path is provided to the plurality of ejection grooves that are communicated to different nozzle rows, and thus the head chip can be more downsized. Note that, the flow path member 11*a* and the flow path member 11*c* are set as the supply ports and the flow path member 11*b* is set as the discharge port, but the flow path member 11*b* may be set as the supply port and the flow path member 11*a* and the flow path member 11*c* may be set as the discharge ports.

In this embodiment, as compared to the second embodiment, on the lower side in the Z direction of the drawing of the piezoelectric plate 6 as the PZT substrate, not the nozzle plate 2 made of polyimide but the reinforcing plate 4 made of ceramics is arranged. With such a configuration, a strain deformation of the piezoelectric element can easily occur. Thus, when a voltage is applied to the side wall, the side wall can bend significantly into a "dogleg" form with substantially the center in the Z direction as the apex. With this, the volume change rate of the ejection groove 7 increases, and hence the speed of jetting the ink droplet can be increased, and further it is possible to support a high-frequency drive speed.

Sixth Embodiment

Figure 8A:
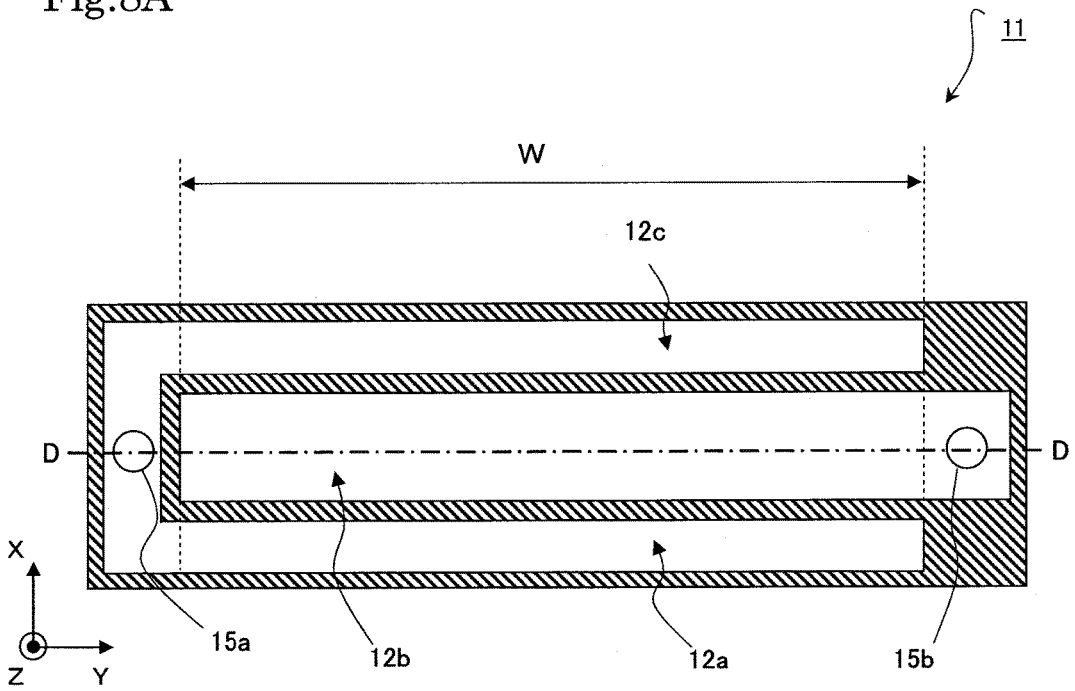
FIGS. 8A and 8B are a front view and a sectional view, respectively, of a flow path member according to a sixth embodiment of the present invention.
Figure 8B:
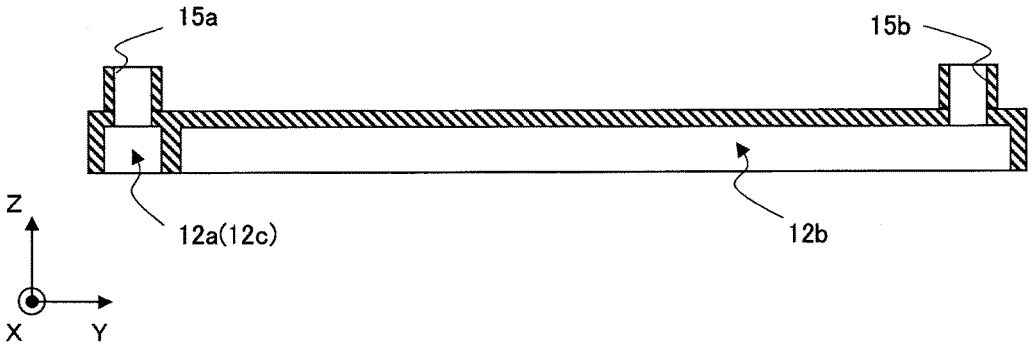
Figure 9:
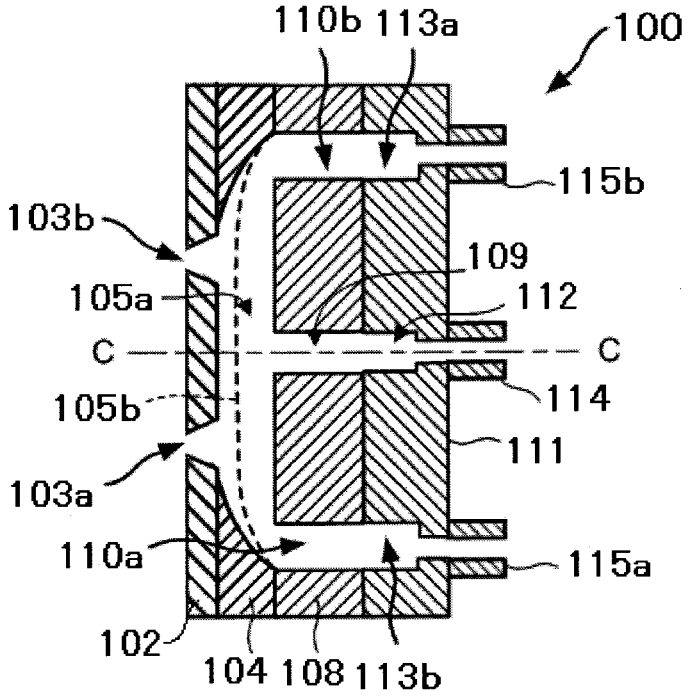
Fig.9 prior art
FIG. 9 is a schematic sectional view of a conventionally known ink jet head.
Figure 10A:
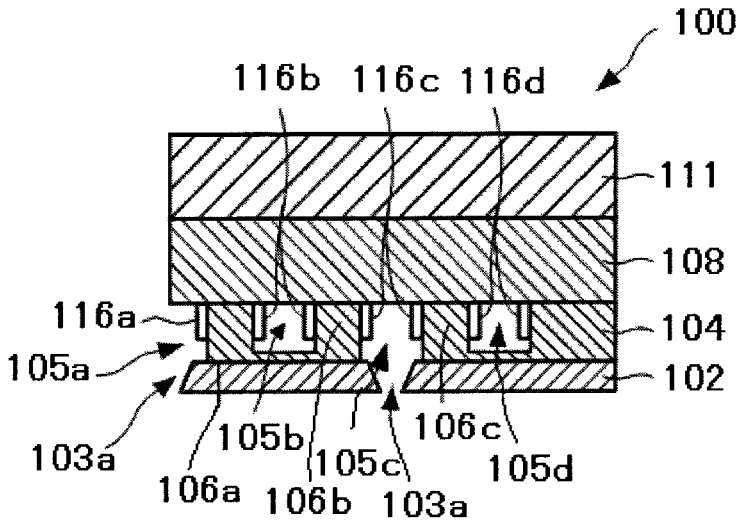
Fig.10A prior art
FIGS. 10A and 10B are schematic sectional views of the conventionally known ink jet head.
Figure 10B:
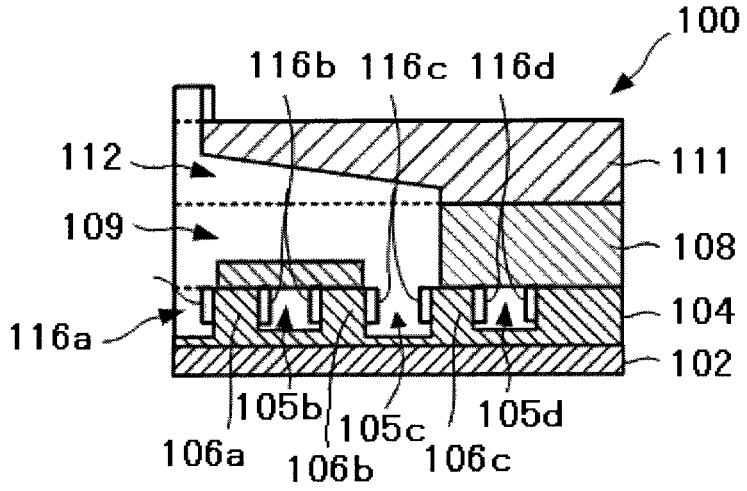
Fig.10B prior art

FIGS. 8A and 8B are a front view and a sectional view, respectively, of the flow path member 11 according to a sixth embodiment of the present invention. Note that, FIG. 8A is a front view of the flow path member 11, and FIG. 8B is a sectional view of the flow path member 11 in a cross section taken along the line DD of FIG. 8A.

The flow path member 11 of the sixth embodiment differs from that of the fifth embodiment in that the flow path member 11 includes an outflow port 15*a* communicating to the first liquid chamber 12*a* and the third liquid chamber 12*c* of the flow path member 11, and an inflow port 15*b* communicating to the second liquid chamber 12*b* thereof. Other configurations are the same as those in the fifth embodiment. Therefore, in the following, configurations different from those in the fifth embodiment are mainly described. The same parts or parts having the same functions are denoted by the same reference symbols.

The flow path member 11 illustrated in FIGS. 8A and 8B has, on one end side (right side of FIGS. 8A and 8B) in the Y direction (longitudinal direction of the flow path member 11), the inflow port 15*b* communicating to the second liquid chamber 12*b*. The inflow port 15*b* is a circular opening opened in the Z direction, and causes liquid (ink) to flow into the second liquid chamber 12*b*. The second liquid chamber 12*b* is a liquid chamber formed so as to have a longitudinal direction from one end side to the other end side in the Y direction. The second liquid chamber 12*b* is formed so as to communicate to the two second common ink chambers 10*b* or the common one second common ink chamber 10*b* (see the fifth embodiment) of the cover plate 9 (not shown), and cover the second common ink chamber 10*b*. With this, the liquid (ink) flown into the second liquid chamber 12*b* flows into the second common ink chamber 10*b*.

Further, the flow path member 11 has, on the other end side (left side of FIGS. 8A and 8B) in the Y direction, the outflow port 15*a* communicating to the first liquid chamber 12*a* and the third liquid chamber 12*c*. The outflow port 15*a* is a circular opening opened in the Z direction, and causes liquid (ink) to flow from the first liquid chamber 12*a* and the third liquid chamber 12*c* to the outside of the flow path member 11. The first liquid chamber 12*a* and the third liquid chamber 12*c* are individual liquid chambers respectively formed so as to have a longitudinal direction from the other end side to the one end side in the Y direction, and are formed into substantially a C-shape. Further, the first liquid chamber 12*a* and the third liquid chamber 12*c* are formed so as to communicate to the first common ink chamber 10*a* and the third common ink chamber 10*c* of the cover plate 9 (not shown), respectively, and cover the first common ink chamber 10*a* and the third common ink chamber 10*c*, respectively. With this, the first liquid chamber 12*a* and the third liquid chamber 12*c* can receive the liquid (ink) flown out to the first common ink chamber 10*a* and the third common ink chamber 10*c*.

Note that, the plurality of ejection grooves 7 (7*a* and 7*b*) of the piezoelectric plate 6 are arranged so as to fall within the range of the width W represented in FIG. 8A. In other words, the outflow port 15*a* and the inflow port 15*b* are formed so as to be located outside the width W. This is for preventing the liquid (ink) from each of the ports 15*a* and 15*b* from directly flowing into the ejection grooves 7 (7*a* and 7*b*). With this, the direct flow is prevented from adversely affecting the liquid (ink) ejection of the ejection grooves 7 (7*a* and 7*b*). Note that, the part outside the width W is sealed by the upper surface of the cover plate 9.

(Manufacturing Steps)

In the following, manufacturing steps for the liquid jet head 1 of the present invention are described.

First, a piezoelectric ceramic substrate which becomes the piezoelectric plate 6 is prepared. This piezoelectric ceramic substrate may be a substrate having the same size as the single piezoelectric plate 6 in the XY plane, or may be a substrate having a size to an extent capable of forming a plurality of piezoelectric plates 6 so that a plurality of piezoelectric plates 6 can be cut out.

Into the surface of the piezoelectric ceramic substrate, a dicing saw is inserted in the depth direction. In the region where the ejection groove 7 is to be formed, the dicing saw is inserted so as to form the ejection groove 7 at a predetermined length in the X direction. In the region where the non-ejection groove 8 is to be formed, the dicing saw is inserted from a predetermined position, and the dicing saw is moved up to a position corresponding to the one end of the piezoelectric plate 6, to thereby form the non-ejection groove 8.

On the surface of the piezoelectric plate 6 in which the grooves are formed, the cover plate 9 is adhered and bonded. The cover plate 9 includes the first common ink chamber 10*a*, the second common ink chamber 10*b*, and the third common ink chamber 10*c*, which pass through the cover plate 9 from one surface to the other surface in the Z direction. The first and second common ink chambers 10*a* and 10*b* communicate to the ejection grooves 7*a* of the piezoelectric plate 6, and the second and third common ink chambers 10*b* and 10*c* communicate to the ejection grooves 7*b* of the piezoelectric plate 6. The non-ejection grooves 8 are closed by the intermediate region of the common ink chambers 10 arrayed in the Y direction so as to prevent entrance of ink.

The flow path member 11 is bonded to the other surface of the cover plate 9. The flow path member 11 is formed so that the respective liquid chambers 12 match with the common ink chambers 10. Further, the second liquid chamber 12*b* is bonded so as to cover in common the second common ink chamber 10*b* and the third common ink chamber 10*c*. In this manner, the flow path members are efficiently arranged. In this case, the three flow path members are separately arranged, but the flow path member including the liquid chamber 12*b* and a common liquid chamber including the liquid chambers 12*a* and 12*c* may be bonded to cover the cover plate 9.

The reinforcing plate 4 is bonded to the other surface of the piezoelectric plate 6, which has been subjected to surface grinding by a grinder to expose the grooves formed by dicing. The reinforcing plate 4 is provided with the through holes 5 in the Z direction. The through hole 5 communicates to the ejection groove 7. The length of the through hole 5 in the X direction is desired to have a length that is substantially the length of the exposed ejection groove 7. The non-ejection grooves 8 are closed by the intermediate region between the through holes arrayed in the Y direction.

The nozzle plate 2 is adhered to the other surface of the reinforcing plate 4. The nozzle plate 2 is bonded so that the center of the nozzle 3 matches with the center of the length of the through hole 5 in the X direction.

What is claimed is:

1. A liquid jet head, comprising:

a nozzle plate including a first nozzle row and a second nozzle row each formed of a plurality of nozzles; and a piezoelectric plate including a plurality of first ejection grooves extending lengthwise in a longitudinal direction and communicating with respective ones of the plurality of nozzles of the first nozzle row, and a plurality of second ejection grooves extending lengthwise in the longitudinal direction and communicating with respective ones of the plurality of nozzles of the second nozzle row, wherein the plurality of first ejection grooves and the plurality of second ejection grooves are not in communication with each other and are separated lengthwise from each other in the longitudinal direction by a partition wall located between the plurality of first ejection grooves and the plurality of second ejection grooves.

2. A liquid jet head according to claim 1, wherein an arrangement direction of the first nozzle row and the second nozzle row is orthogonal to the longitudinal direction of the plurality of first ejection grooves and the plurality of second ejection grooves.

3. A liquid jet head according to claim 1, wherein the longitudinal direction of the plurality of first ejection grooves and the plurality of second ejection grooves is inclined at a predetermined angle relative to an arrangement direction of the first nozzle row and the second nozzle row.

4. A liquid jet head according to claim 1, wherein the piezoelectric plate further includes a plurality of first non-ejection grooves formed alternately with the plurality of first ejection grooves in an arrangement direction of the first nozzle row, and a plurality of second non-ejection grooves formed alternately with the plurality of second ejection grooves in an arrangement direction of the second nozzle row.

5. A liquid jet head according to claim 4, wherein the plurality of first ejection grooves are adjacent respective ones of the plurality of second non-ejection grooves with the partition wall separating the first ejection grooves from the second non-ejection grooves, and wherein the plurality of second ejection grooves are adjacent respective ones of the plurality of first non-ejection grooves with the partition wall separating the second ejection grooves from the first non-ejection grooves.

6. A liquid jet head according to claim 4, wherein the plurality of first ejection grooves are adjacent respective ones of the plurality of second ejection grooves with the partition wall separating the first ejection grooves from the second ejection grooves, and wherein the plurality of first non-ejection grooves are adjacent respective ones of the plurality of second non-ejection grooves with the partition wall separating the first non-ejection grooves from the second non-ejection grooves.

7. A liquid jet head according to claim 1, wherein the plurality of nozzles are provided in a staggered arrangement in which, in an arrangement direction of the plurality of nozzles, each of nozzles in the first nozzle row is located between nozzles in the second nozzle row.

8. A liquid jet head according to claim 1, further comprising a cover plate including:

a first supply ink chamber communicating to the plurality of first ejection grooves, for supplying liquid to the plurality of first ejection grooves;

a first discharge ink chamber for discharging the liquid from the plurality of first ejection grooves;

a second supply ink chamber communicating to the plurality of second ejection grooves, for supplying the liquid to the plurality of second ejection grooves; and a second discharge ink chamber for discharging the liquid from the plurality of second ejection grooves.

9. A liquid jet head according to claim 8, further comprising a flow path member including:

a supply port for supplying the liquid to the first supply ink chamber and the second supply ink chamber; and a discharge port for discharging the liquid from the first discharge ink chamber and the second discharge ink chamber.

10. A liquid jet head according to claim 1, further comprising a reinforcing plate bonded between the nozzle plate and the piezoelectric plate, the reinforcing plate including a plurality of through holes respectively communicating to the plurality of nozzles, the plurality of first ejection grooves, and the plurality of second ejection grooves.

11. A liquid jet apparatus, comprising the liquid jet head according to claim 1.

12. A liquid jet head according to claim 2, wherein the piezoelectric plate further includes a plurality of first non-ejection grooves formed alternately with the plurality of first ejection grooves in an arrangement direction of the first nozzle row, and a plurality of second non-ejection grooves formed alternately with the plurality of second ejection grooves in an arrangement direction of the second nozzle row.

13. A liquid jet head according to claim 12, wherein the plurality of first ejection grooves are adjacent respective ones of the plurality of second non-ejection grooves with the partition wall separating the first ejection grooves from the second non-ejection grooves, and wherein the plurality of second ejection grooves are adjacent respective ones of the plurality of first non-ejection grooves with the partition wall separating the second ejection grooves from the first non-ejection grooves.

14. A liquid jet head according to claim 12, wherein the plurality of first ejection grooves are adjacent respective ones of the plurality of second ejection grooves with the partition wall separating the first ejection grooves from the second ejection grooves, and wherein the plurality of first non-ejection grooves are adjacent respective ones of the plurality of second non-ejection grooves with the partition wall separating the first non-ejection grooves from the second non-ejection grooves.

15. A liquid jet apparatus, comprising the liquid jet head according to claim 2.

16. A liquid jet head according to claim 2, further comprising a cover plate including:

a first supply ink chamber communicating to the plurality of first ejection grooves, for supplying liquid to the plurality of first ejection grooves;

a first discharge ink chamber for discharging the liquid from the plurality of first ejection grooves;

a second supply ink chamber communicating to the plurality of second ejection grooves, for supplying the liquid to the plurality of second ejection grooves; and a second discharge ink chamber for discharging the liquid from the plurality of second ejection grooves.

17. A liquid jet head according to claim 16, further comprising a flow path member including:

a supply port for supplying the liquid to the first supply ink chamber and the second supply ink chamber; and a discharge port for discharging the liquid from the first discharge ink chamber and the second discharge ink chamber.

18. A liquid jet head according to claim 3, wherein the piezoelectric plate further includes a plurality of first non-ejection grooves formed alternately with the plurality of first ejection grooves in an arrangement direction of the first nozzle row, and a plurality of second non-ejection grooves formed alternately with the plurality of second ejection grooves in an arrangement direction of the second nozzle row.

19. A liquid jet head according to claim 18, wherein the plurality of first ejection grooves are adjacent respective ones of the plurality of second non-ejection grooves with the partition wall separating the first ejection grooves from the second non-ejection grooves, and wherein the plurality of second ejection grooves are adjacent respective ones of the plurality of first non-ejection grooves with the partition wall separating the second ejection grooves from the first non-ejection grooves.

20. A liquid jet head according to claim 18, wherein the plurality of first ejection grooves are adjacent respective ones of the plurality of second ejection grooves with the partition wall separating the first ejection grooves from the second ejection grooves, and wherein the plurality of first non-ejection grooves are adjacent respective ones of the plurality of second non-ejection grooves with the partition wall separating the first non-ejection grooves from the second non-ejection grooves.

21. A liquid jet head according to claim 1, wherein the nozzles communicate with the ejection grooves at longitudinal center portions of the ejection grooves.

22. A liquid jet head according to claim 1, wherein the piezoelectric plate is a single piezoelectric plate.

* * * * *